US011111038B2

(12) United States Patent
Peccetti

(10) Patent No.: US 11,111,038 B2
(45) Date of Patent: Sep. 7, 2021

(54) PERFECTED MACHINE AND METHOD FOR PACKAGING IN EXTENSIBLE FILM PRODUCTS FED IN GROUPS OR INDIVIDUALLY

(71) Applicant: Colines S.p.A., Novara (IT)

(72) Inventor: Francesco Peccetti, Sizzano (IT)

( * ) Notice: Subject to any disclaimer, the term of this patent is extended or adjusted under 35 U.S.C. 154(b) by 190 days.

(21) Appl. No.: 16/339,509

(22) PCT Filed: Oct. 10, 2017

(86) PCT No.: PCT/EP2017/075772

§ 371 (c)(1),
(2) Date: Apr. 4, 2019

(87) PCT Pub. No.: WO2018/073045

PCT Pub. Date: Apr. 26, 2018

(65) Prior Publication Data

US 2019/0241291 A1 Aug. 8, 2019

(30) Foreign Application Priority Data

Oct. 17, 2016 (IT) ..... 102016000103903

(51) Int. Cl.
*B65B 11/02* (2006.01)
*B65B 21/24* (2006.01)
(Continued)

(52) U.S. Cl.
CPC ..... *B65B 11/025* (2013.01); *B65B 21/245* (2013.01); *B65B 35/44* (2013.01); *B65B 61/10* (2013.01); *B65B 2210/18* (2013.01)

(58) Field of Classification Search
CPC . B65B 2210/20; B65B 11/025; B65B 21/245; B65B 2210/18
(Continued)

(56) References Cited

U.S. PATENT DOCUMENTS 4,058,427 A * 11/1977 Wilson ..... B29C 63/105 156/392
RE30,369 E * 8/1980 Wilson ..... B29C 63/105 156/392
(Continued)

FOREIGN PATENT DOCUMENTS

EP 0713828 5/1996
EP 1489003 12/2004
(Continued)

*Primary Examiner* — Robert F Long
*Assistant Examiner* — Xavier A Madison
(74) *Attorney, Agent, or Firm* — Themis Law

(57) ABSTRACT

A packaging machine using extensible film for products fed in groups or individually includes a conveyor feeding the product, a product positioning unit, a film winding unit and a discharge conveyor positioned at the outlet of the winding unit. The winding unit is a ring winder having a ring rotating with respect to guiding rolls, positioned on a supporting frame, and arranged on a plane perpendicular to the advance direction of the products. A shelf is provided beneath the winding unit, cantilevered for extending in the advance direction of the products, and connects the feeding conveyor with the winding unit. A vacuum-effect gripping unit is positioned beneath the shelf for gripping the film and carries a cutting unit. The vacuum-effect gripping unit and the cutting unit can be moved alternatingly and selectively from a withdrawn rest position of the shelf to an extended position for gripping and cutting the film.

13 Claims, 15 Drawing Sheets

(51) Int. Cl.
*B65B 61/10* (2006.01)
*B65B 35/44* (2006.01)

(58) Field of Classification Search
USPC ..... 53/427
See application file for complete search history.

(56) References Cited

U.S. PATENT DOCUMENTS

| | | | | |
|---|---|---|---|---|
| 4,524,568 | A | 6/1985 | Lancaster | |
| 5,404,691 | A * | 4/1995 | Scherer | B65B 11/025 53/399 |
| 5,531,061 | A | 7/1996 | Peterson | |
| 5,564,258 | A * | 10/1996 | Jones, Sr. | B65B 11/008 53/399 |
| 7,661,244 | B2 * | 2/2010 | Downhill | B65B 61/10 53/176 |
| 2012/0180430 | A1 * | 7/2012 | Lavoie | A01F 25/14 53/203 |
| 2017/0057673 | A1 * | 3/2017 | Corberi | B65B 11/025 |
| 2018/0290776 | A1 * | 10/2018 | Cere | B65B 41/18 |

FOREIGN PATENT DOCUMENTS

| | | |
|---|---|---|
| WO | 2009155713 | 12/2009 |
| WO | 2015-121334 | 8/2015 |

* cited by examiner

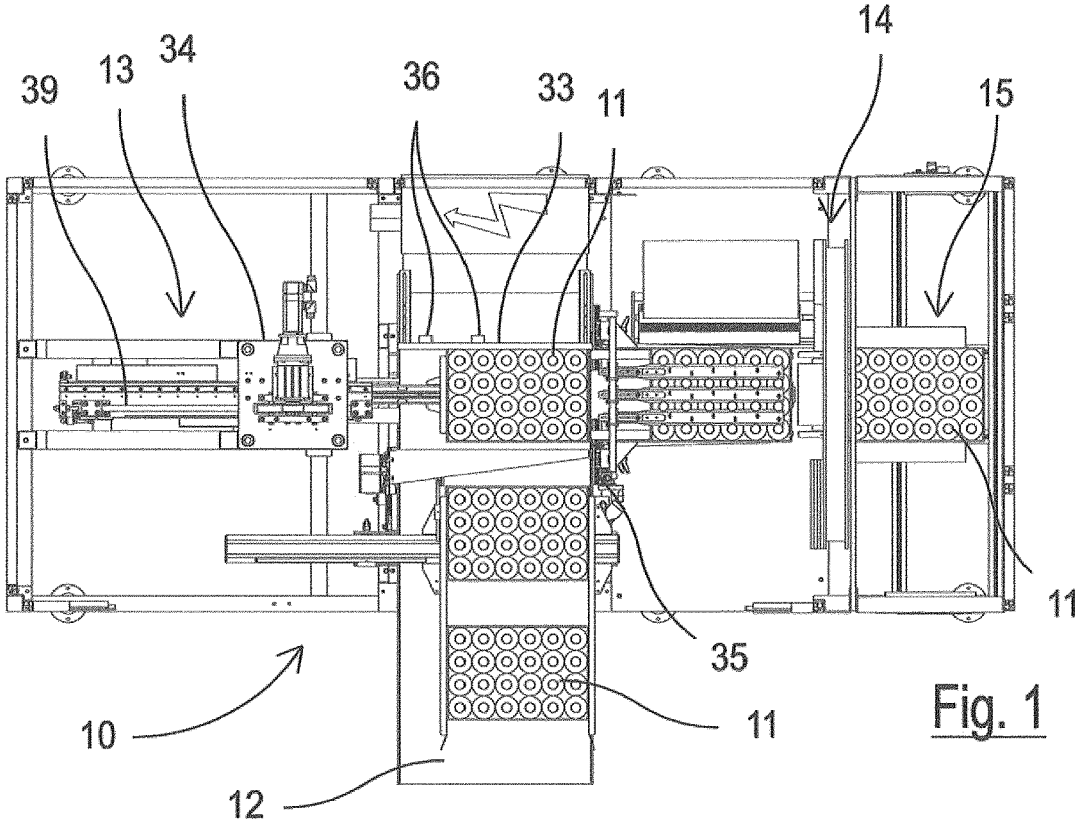
Fig. 1
Fig. 2
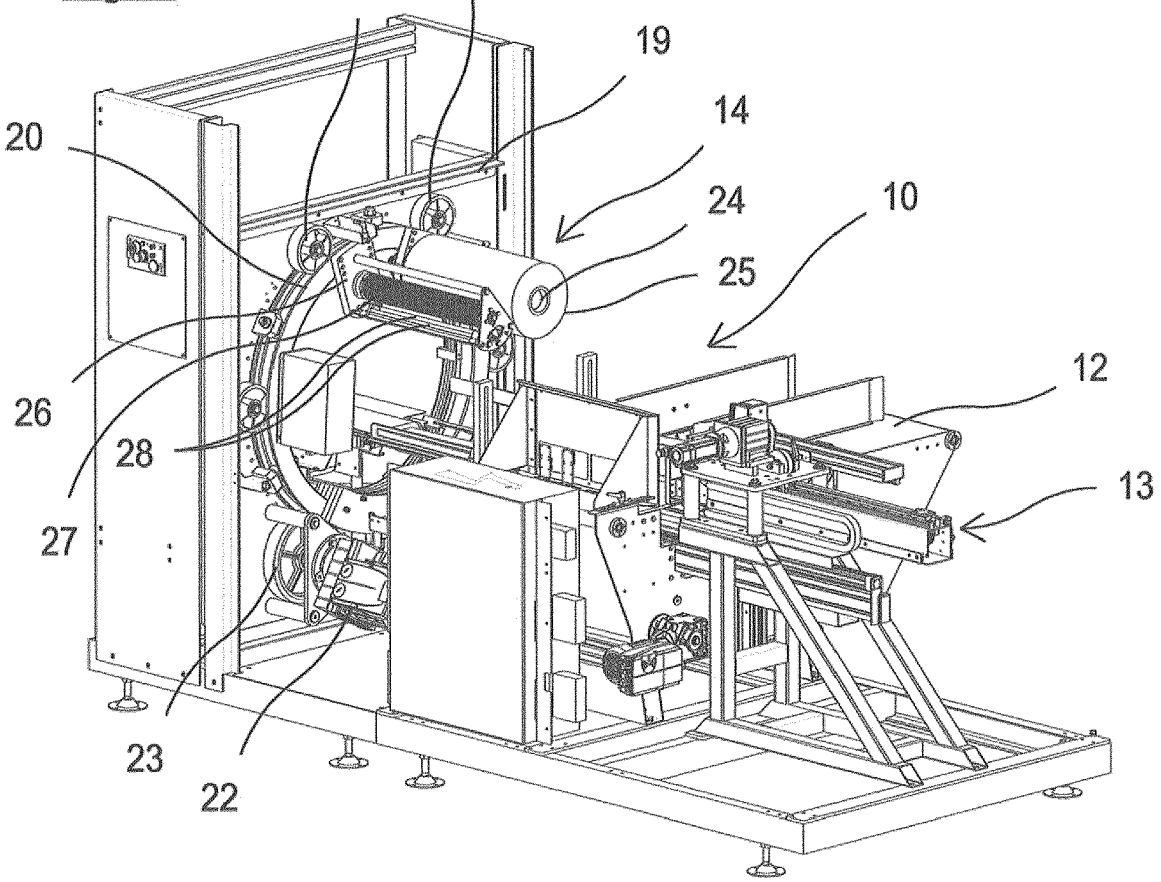

PERFECTED MACHINE AND METHOD FOR PACKAGING IN EXTENSIBLE FILM PRODUCTS FED IN GROUPS OR INDIVIDUALLY

The present invention relates to a perfected machine and method for packaging products in extensible film, fed in groups or individually.

In the field of packaging of various types of products fed in groups, such as, for example, bottles, boxes of various sizes, etc., a film of plastic material of the shrinkable type treated by a specific machine, is currently mostly used. This film is wound around the product or groups of products, then welded and cut to size and subsequently inserted in a heat shrink oven which stabilizes the packaging thus obtained, keeping the products stably in its interior.

This kind of technique implies a certain cost for plastic material having a certain thickness, a cost for the energy used for the heat shrinking in addition to a plant cost which requires the presence of a packaging machine and relative heat shrink oven associated with the same. Last but not least there is a further increase in costs due to the considerable time necessary for obtaining the final heat-shrunk packaging of products.

As an alternative, a film of extensible plastic film can be used for the packaging which is wound around the products. The products are divided into groups and selectively wound in correspondence with a winding unit. In this winding unit, a reel of extensible plastic film is rotated around the products carried by a conveyor belt or roller conveyor and, at the end of the winding, the packaging thus obtained is discharged. The cutting of the film after being wound around the products and the repositioning of the film to prepare it for being wound around a subsequent new group of products to be packaged, creates various problems in this packaging unit.

This problem is particularly felt in the case of a ring winding machine, which is particularly fast and functional.

WO 2015/121334 relates to a packaging machine with extensible film in which a shelf is provided, which receives the corresponding products to be packaged. An elongated hollow element is positioned above the shelves, which ends laterally close to the packages being packed and externally has at least one suction opening. Separately and below the shelf, in a withdrawn position with respect to the other elements of the machine, a retaining clamp of an edge of the film is provided which also cuts said film.

The general objective of the present invention is to provide a perfected packaging machine in extensible film, of products fed in groups, capable of solving the above drawbacks of the known art in an extremely simple, economical and particularly functional manner.

A further objective of the present invention is to provide a packaging machine which can function almost continuously, at a high rate, without any cutting or insertion interventions of the film which is being wound around the group of products, eliminating any kind of stoppage in the packaging phase and operating almost automatically.

Another objective of the present invention is to provide a packaging machine of products which, by using an extensible film, reduces costs relating to the packaging material.

Yet another objective of the present invention is to provide a packaging method which can function almost continuously, at a high rate, without any cutting or insertion interventions of the film which is being wound around the group of products, eliminating any kind of stoppage during the packaging phase and operating almost automatically.

The above objectives are achieved by a machine and method produced according to the independent claims and following subclaims.

The structural and functional characteristics of the present invention and its advantages with respect to the known art will appear even more evident from the following description referring to the enclosed schematic drawings, which show an embodiment example of the invention itself. In the drawings:

FIG. 1 is a plan view from above illustrating a perfected packaging machine in extensible film of products according to the invention.

FIGS. 2, 3 and 4 are perspective views of the packaging machine in extensible film of products of FIG. 1 without the discharge conveyor;

Figure 3:
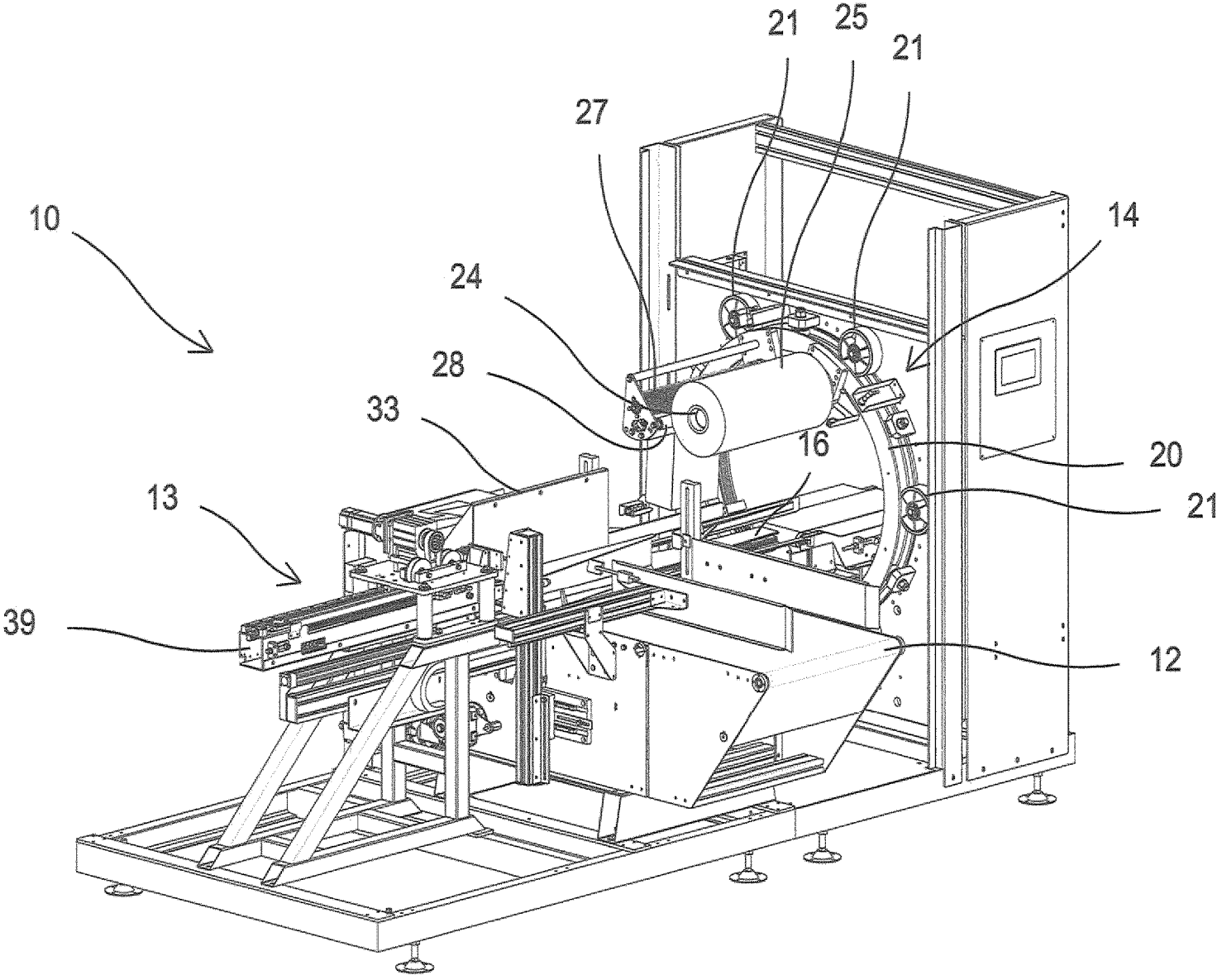
Figure 4:
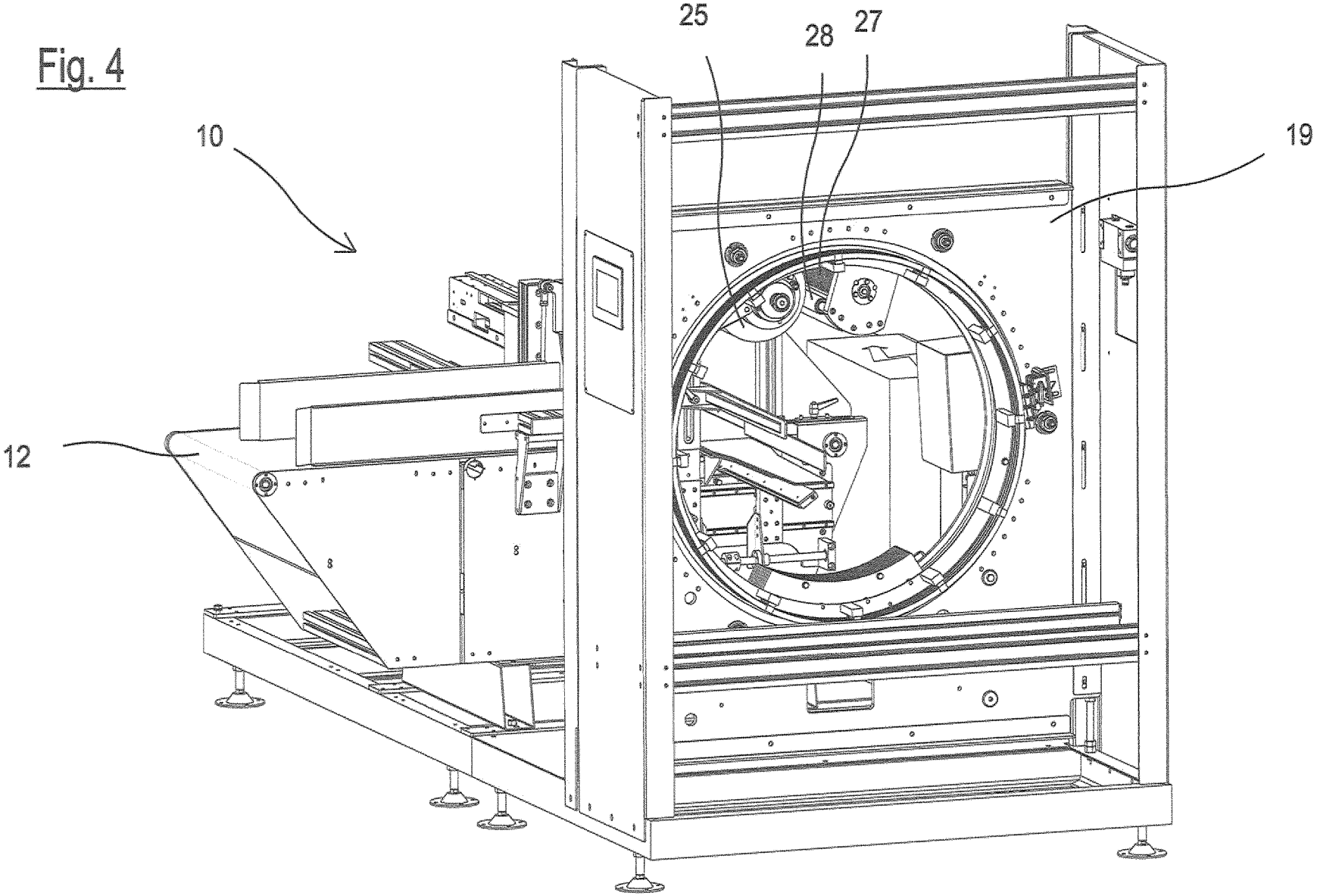

With reference to the figures, these show a perfected packaging machine in extensible film of products fed in groups, such as bottles, boxes or other objects, or individually as single products 11, the machine being indicated as a whole with 10.

It should be considered that, upstream of this machine 10, the single products 11 can be positioned in order, for example on a certain number of rows, aligned and adjacent or as a single product. Hereinafter reference will be made to "product 11" even when there are various products. Consequently, the product 11 is moved forwards up to a feeding conveyor 12 of the packaging machine, for example a conveyor belt.

The machine of the invention essentially comprises the conveyor 12 for feeding the product 11, a positioning unit 13 of the product, a film winding unit 14 of the single product or groups of products and a discharge conveyor 15 positioned at the outlet of the winding unit 14, for example a conveyor belt.

In short, the product 11 coming from an upstream movement or charged manually, reaches the belt conveyor 12 at the inlet. The conveyor belt 12 can be in line (not shown) or at 90° (as in the example illustrated) with respect to the linear positioning group 13. In this way, the product 11, when it has reached the conveyor belt 12 in correspondence with the positioning unit 13, it is moved inside the winding unit 14, simultaneously pushing the product 11 which has been wound in the previous cycle onto the discharge conveyor belt 15 which, thus packaged, discharges it. Once the positioning of the product to be wound has been completed, the winding cycle is initiated. The reference production capacity, which also depends on the type of product, can be about 10-12 packages/min.

More specifically, a bridge structure is positioned downstream of the conveyor belt 12 and before the winding unit 14, which receives the product 11 to be wound for creating the final packaging or package. Said bridge structure comprises a shelf 16 cantilevered for extending from a supporting frame 17, according to the advance direction of the product 11. The shelf 16 connects the conveyor belt 12 with the subsequent winding unit 14. Pairs of side guiding bars 38, also cantilevered to form the bridge structure, keep the product 11 in line, compact and orderly, if there is more than one.

The shelf 16 cantilevered and extending from the frame 17 is such as to enable a vacuum-effect gripping unit 18 to be movably positioned beneath it. The shelf 16 is also such as to facilitate the sliding of the film when, once wound onto the product, it slips off the shelf before being expelled through the positioning unit 13.

As already indicated, the shelf 16 is positioned near the winding unit 14. The winding unit 14 comprises a frame 19, positioned astride with respect to the product 11 arranged on the shelf.

The ring winding unit 14 comprises a ring or slewing ring 20 which rotates with respect to guiding rolls 21, positioned on the frame 19. Said ring 20 is arranged on a plane perpendicular to the advance direction of the product 11. A motor reducer 22 integral with the frame 19, controls the rotation of the ring 20 by means of a controlling friction roller 23.

A reel holder 24 for a reel 25 of extensible plastic film is assembled integral with the ring 20. A support 26 of a rubberized tensioning roller 27 and a pair of return rollers 28 for the film are associated with this reel holder 24. The tension of the film being unwound can be regulated, by means of a brake (not shown) for example, which acts directly on said rubberized tensioning roller 27.

During the winding process of the film around the product 11, the rotating ring 20 rotates for a programmable number of turns to allow the correct quantity of film to be deposited.

Figure 8:
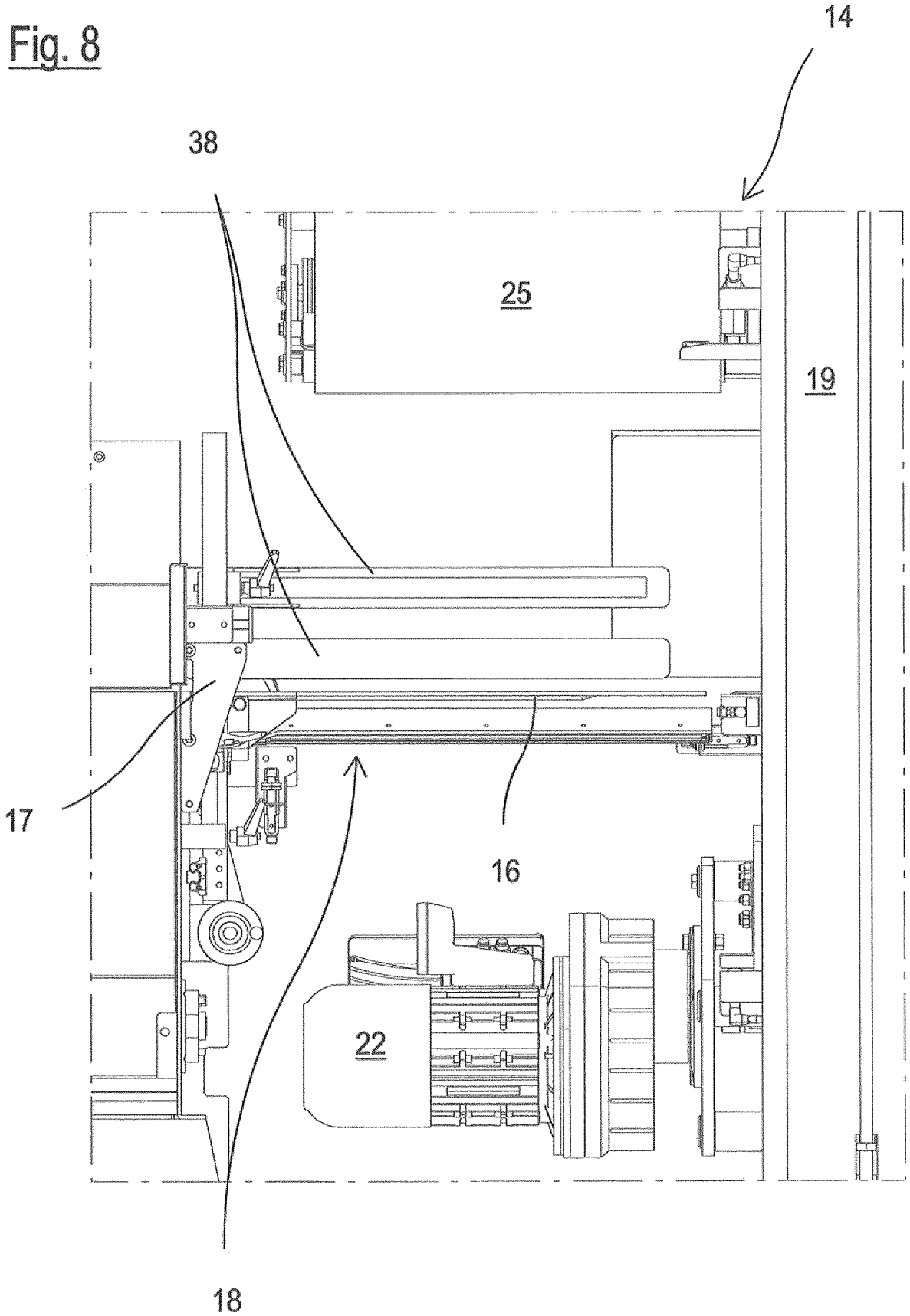
Figure 9:
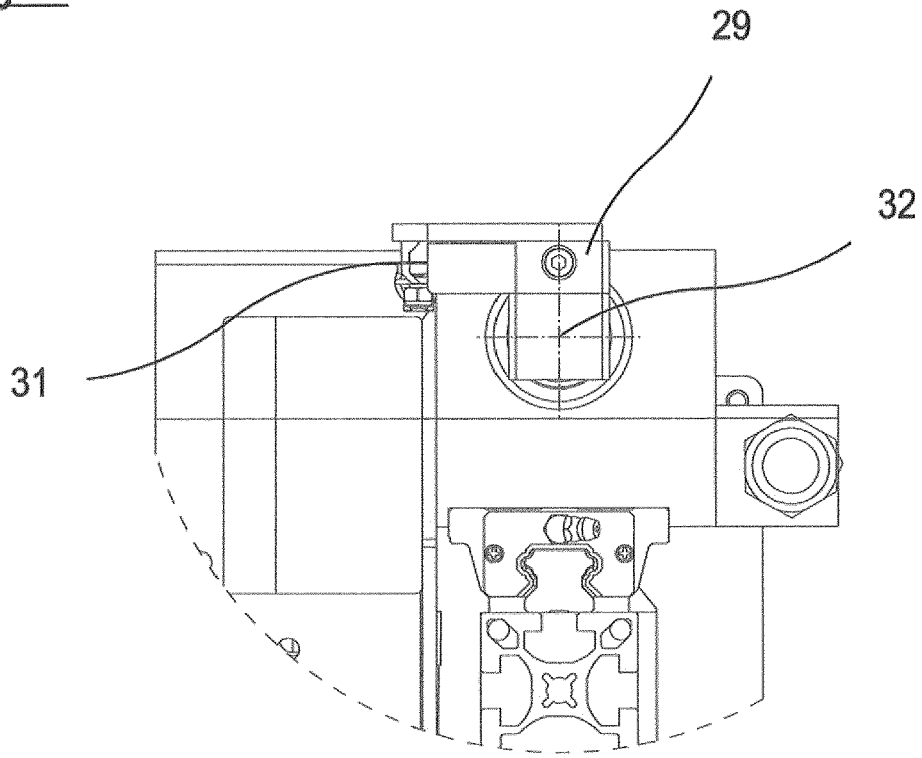
FIGS. 9 and 10 are two enlarged raised front views of ends of the gripper in a gripping position and in a cutting position.
Figure 10:
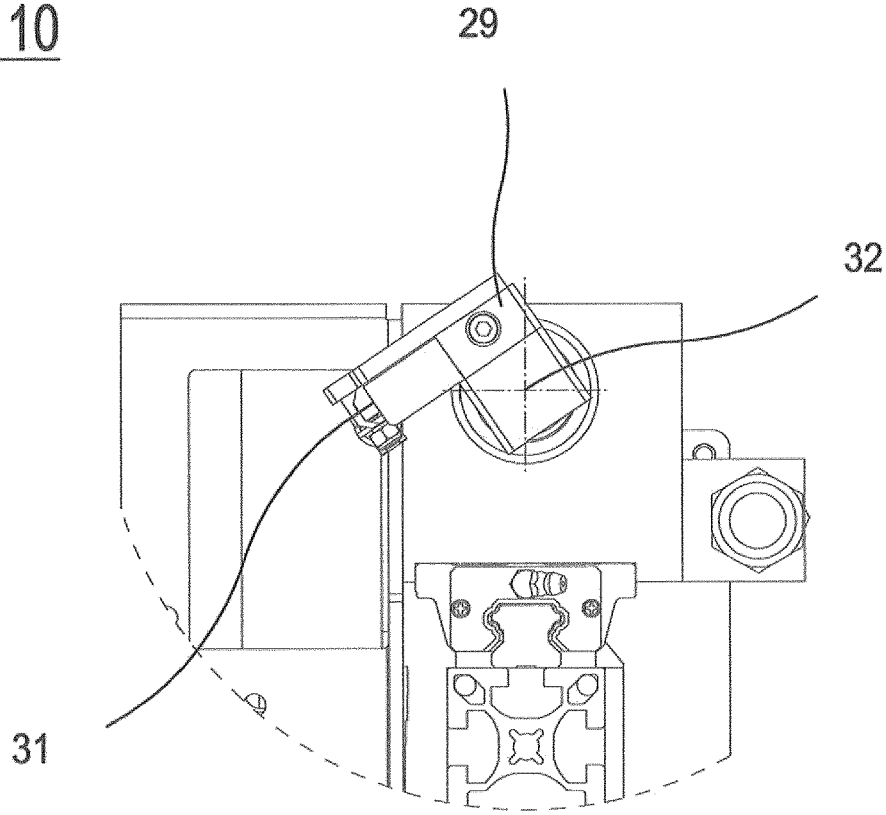

As already indicated, according to the present invention, the extensible film close to the winding group 14 is withheld by a vacuum-effect gripping unit 18. Said vacuum-effect gripping unit 18 can be moved from an extended position beneath the shelf 16 carrying the product 11 to be wound or already wound (FIG. 7) to a withdrawn rest position of the shelf 16 (FIG. 6) after releasing the film wound onto the product. The vacuum-effect gripping unit 18 is in fact withdrawn, releasing the film after the winding ring 20 has effected various turns so as to fix the film to the product(s) 11. During the last of these turns, the gripping unit 18 re-exits and, as the film passes, it sucks it, withholding it (FIG. 9), and also cuts it with a cutting element such as a hot blade brought into contact with the film by means of a rotating movement (FIGS. 8 and 10).

More specifically, the vacuum-effect gripping unit 18, shown in greater detail in FIGS. 11 to 14, comprises a hollow tubular section 29. A vacuum is created in said hollow tubular section 29 and, thanks to the presence below of suction holes or sectors 30, it holds the film in a gripping position. Laterally, the hollow tubular section 29 carries a cutting element in the form of a cutting blade 31 for the same film. Said hollow tubular section 29 and consequently the cutting blade 31 can be rotated around a horizontal axis 32 so as to effect the cutting action.

Figure 11:
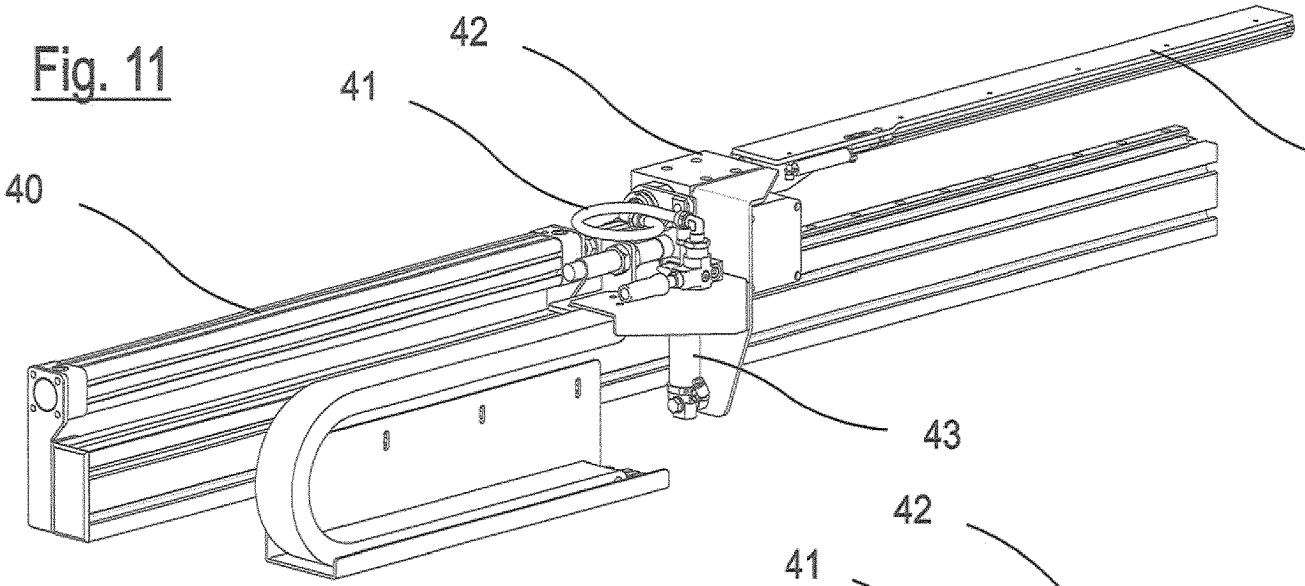
FIGS. 11 and 12 are perspective views of the gripping unit alone in a rest position and in a gripping position, respectively.
Figure 12:
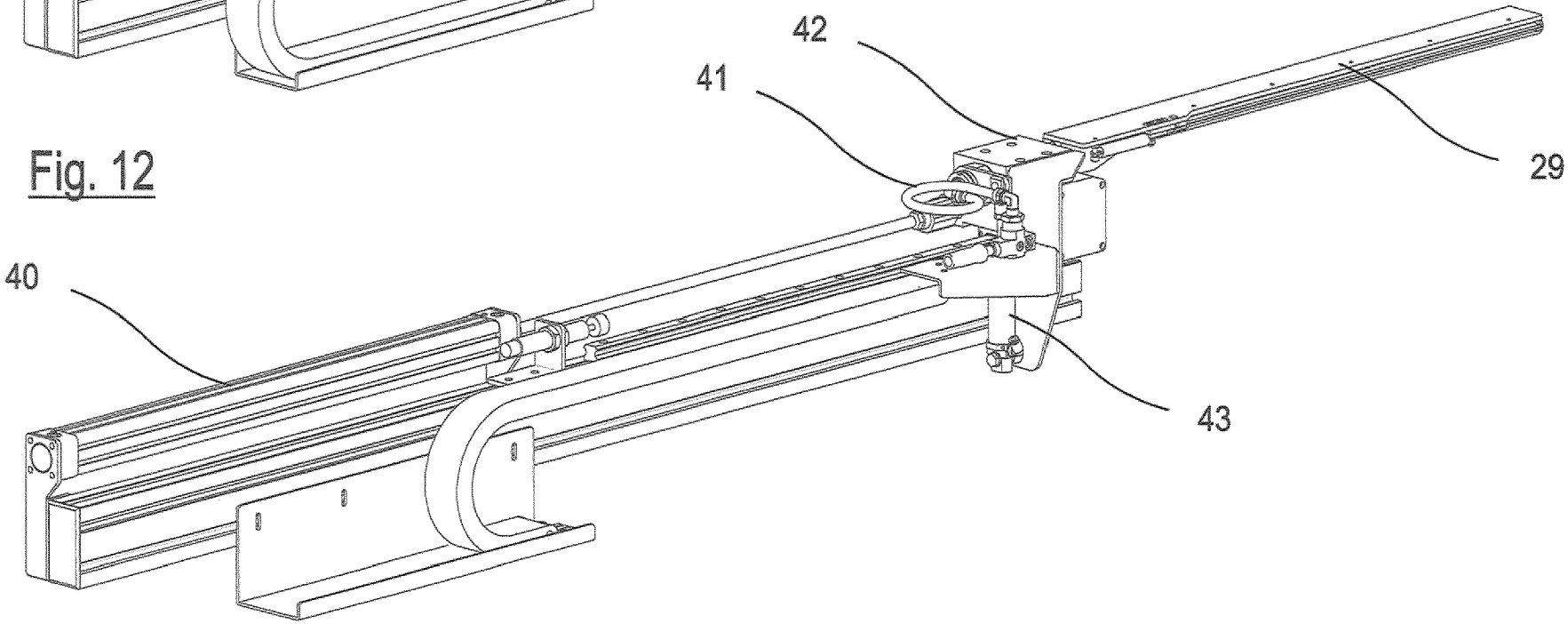

As shown in FIGS. 11 and 12, the hollow tubular section 29 is moved between a rest position and a gripping position respectively, by means of a linear actuator, such as a cylinder 40.

A pipe 41 connects the hollow tubular section 29 to a vacuum pump (not shown) thus causing suction from the above-mentioned holes or sectors 30 for the edge of the film to be blocked.

The rotation movement of the hollow tubular section 29 for bringing the cutting blade 31 to act on the film, cutting it, is actuated by a set-square lever 42 driven by an actuator 43, such as a cylinder.

Figures 13, 14:
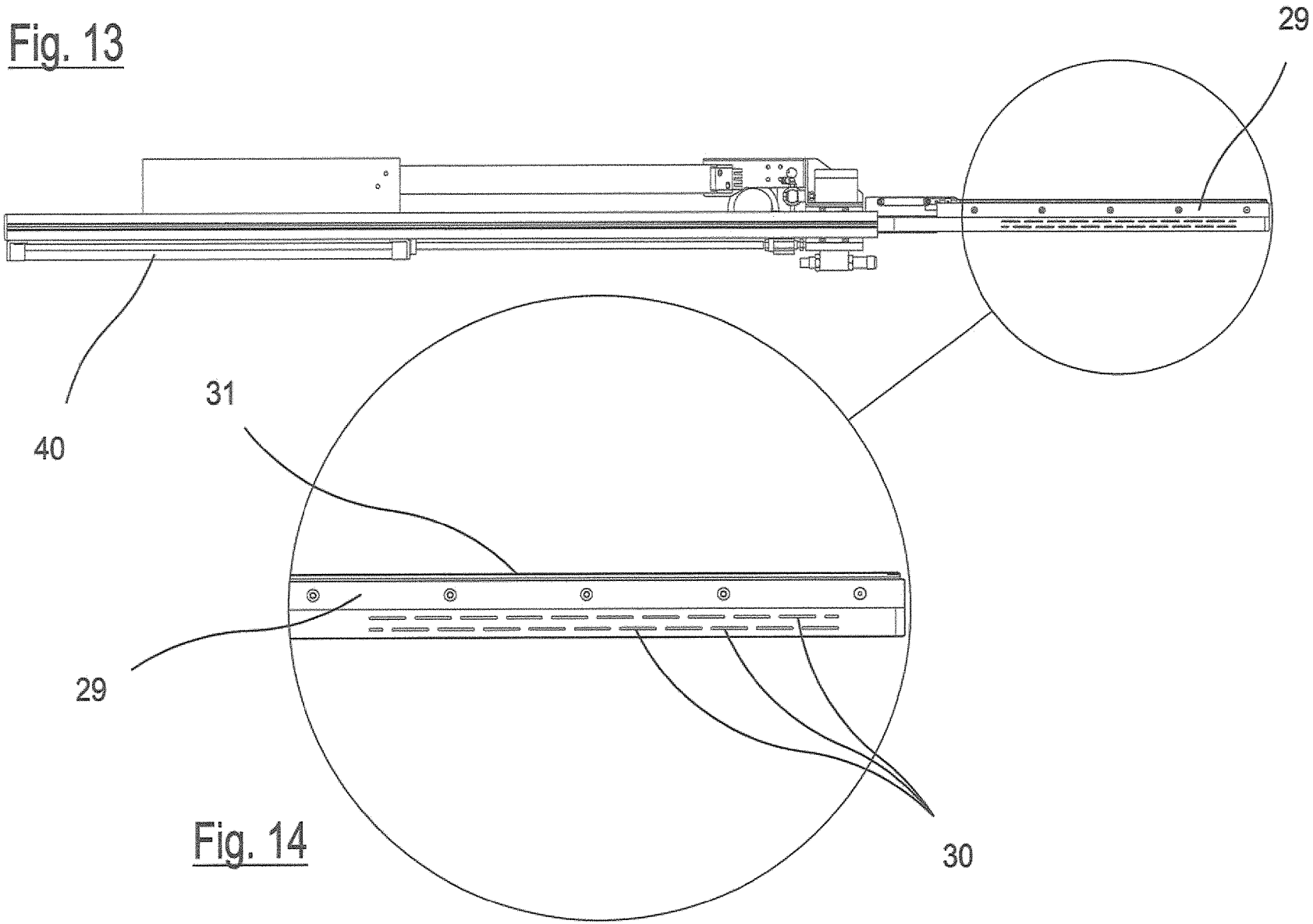
FIG. 13 shows a view from below of the gripping unit in a gripping position.
FIG. 14 shows an enlarged detail of the gripping unit of FIG. 13.

FIG. 13 shows a view from below of the gripping unit in a gripping position. In this position, the hollow tubular section 29 is extracted by means of the cylinder 40 and brought to a gripping position in which the holes or sectors 30 are ready for blocking the film.

FIG. 14 shows an enlarged detail of the gripping unit of FIG. 13 in which the holes or sectors 30, and also the cutting blade 31, can be clearly seen.

The functioning of a machine according to the present invention is as follows.

The feeding conveyor 12 of the products 11, consisting for example of a low-friction polypropylene belt, allows the product(s) 11 to slide during the pushing phase towards the winding group 14. The belt is moved with an asynchronous motor controlled by an inverter. The inverter is present for regulating the velocity, acceleration and deceleration in relation to the product to be wound.

The product or products 11 move on the belt 12 and are intercepted by a photocell 35 which is positioned transversally with respect to the belt 12. When this photocell 35 is released as a result of the advancement of the product 11, the belt 12, if necessary, decelerates, reaching an adequate velocity for the product 11 and stops when the product 11 intercepts one of the two capacitive sensors 36 positioned on an end abutment 33. The rotation rates can be programmed by a panel and the advancement rates, which vary from 0-20 mt/min, can be programmed directly on the inverters.

At this point, the product 11 is ready for being loaded into the winding unit 14 from the positioning unit 13.

The positioning unit 13, for example, is composed of a telescopic actuator 39 with a linear axis which, by means of a pusher 34, moves the product 11 inside the winding unit 14 above the shelf 16. The telescopic actuator 39 is moved, for example, by a synchronous motor. The run of the actuator is about 1,000 mm, a precision of +/− 5 mm is sufficient in the positioning. The advance rate depends on the product 11 to be moved, the return is at maximum speed so as to bring the subsequent product 11 in position in the shortest time possible. The positioning unit 13 can be completed, depending on the product to be wound, by pneumatic systems for guiding or keeping the product firm during the thrust. The advance rate is 0-40 mt/min.

When the product 11 is correctly positioned beneath the ring 20 of the winding unit 14, the initial edge of the film is withheld by the vacuum-effect gripping unit 18. The initial edge of the film is in fact sucked and withheld by the vacuum created inside the hollow tubular section 29.

Figure 6:
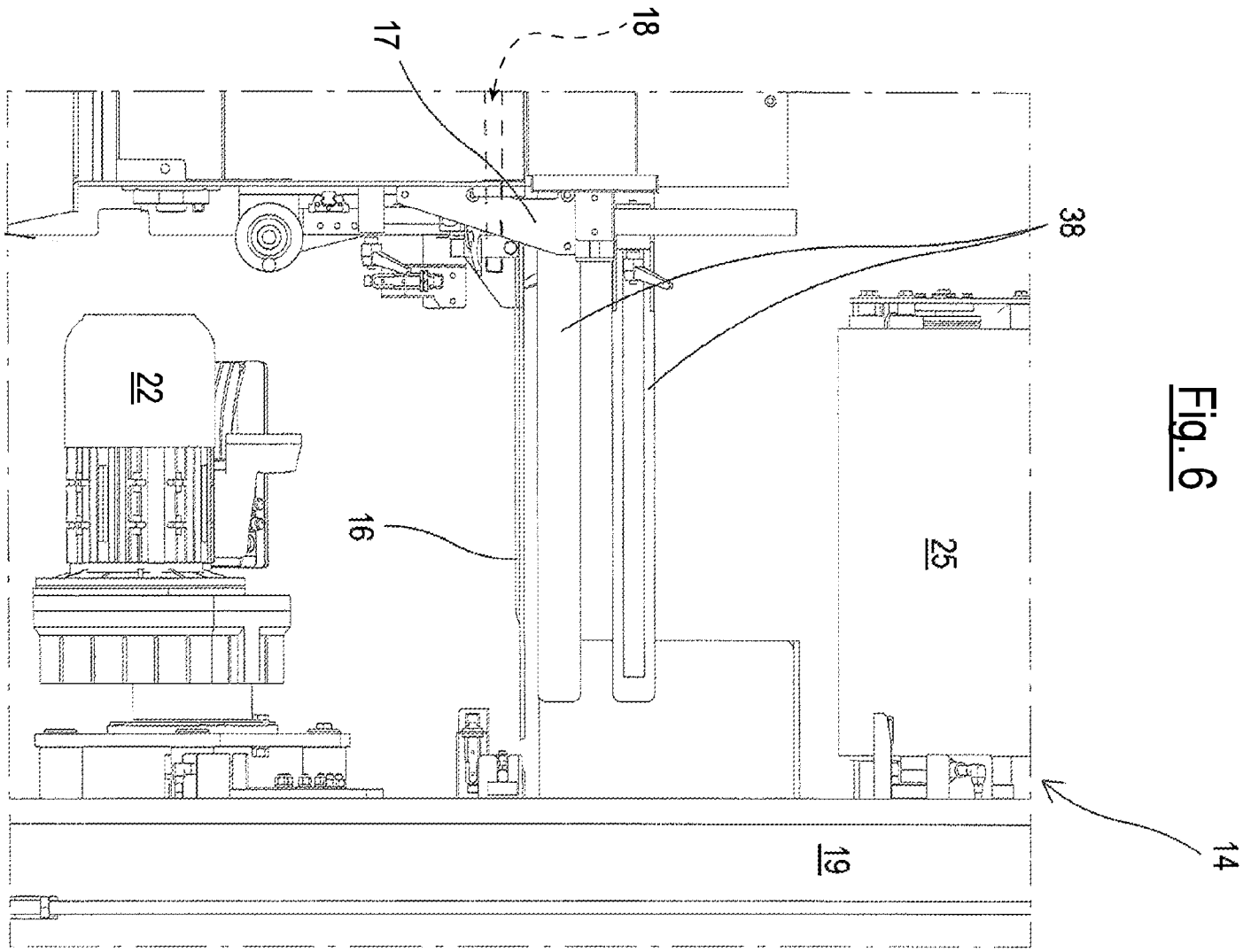
FIGS. 6, 7 and 8 are raised side views of the machine in correspondence with the winding unit and gripping unit in three different operational rest, gripping and cutting positions of the gripping unit.

In this condition, the rotation of the winding ring 20 is started and the gripping unit is withdrawn allowing a firm winding of the film onto the products 11 and in FIG. 6, the withdrawn position can be noted of the gripping unit 18, which cannot be seen and is dotted.

The ring 20 then effects various turns so as to firmly fix the film to the product(s) 11. During the last of these turns, the gripping unit 18 re-exits (FIG. 8) and, as the film as passing, it sucks it, withholding it (FIG. 9) acquiring a gripping position (see also FIG. 12).

Figure 5:
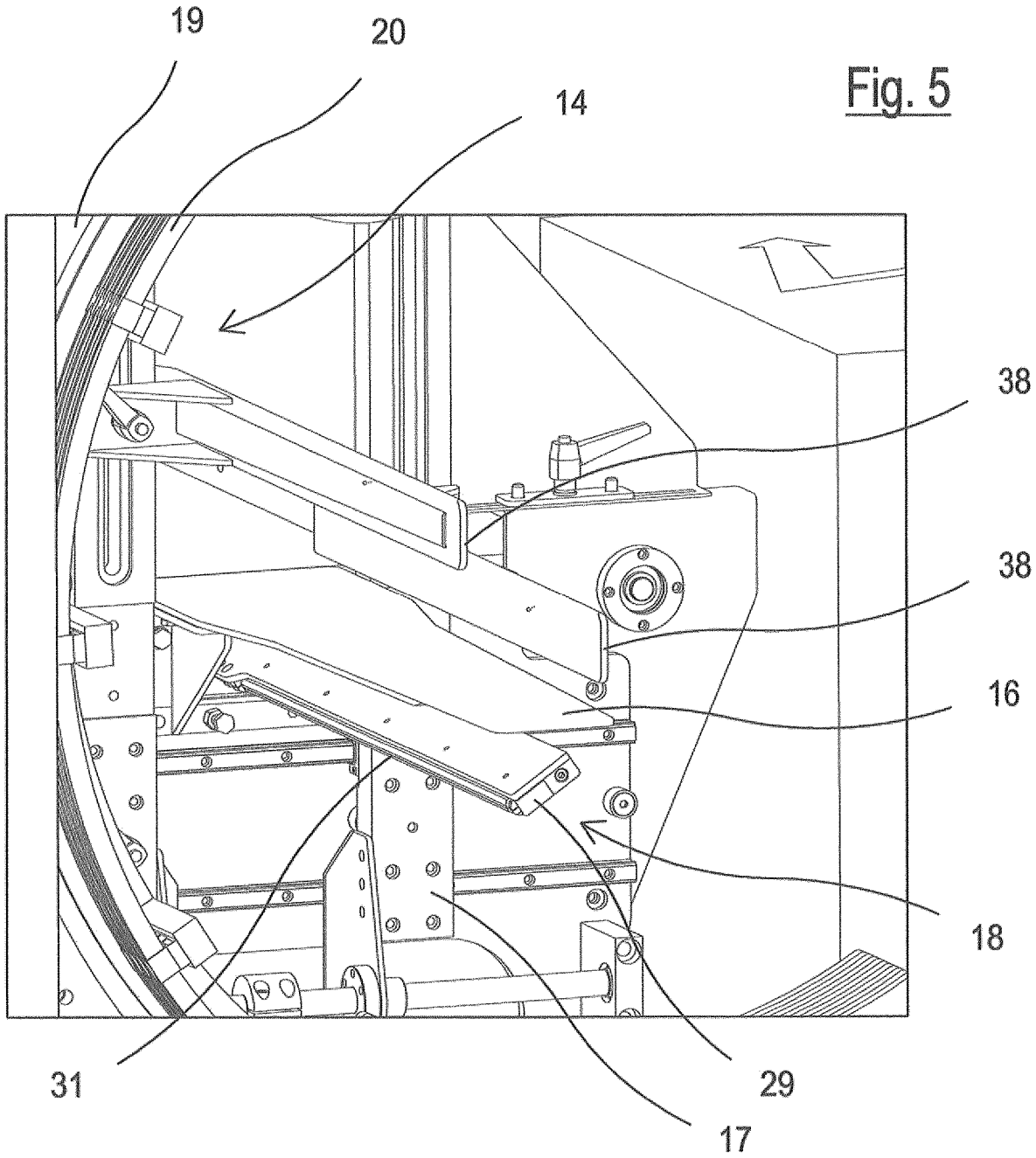
FIG. 5 is an enlarged detail of what is shown in FIG. 4 highlighting the vacuum-effect gripping unit, in an extracted and rotated position.

After effecting the gripping, the gripping unit 18 is commanded to rotate so as to cut the film with the hot blade 31 which is brought into contact with the film itself by means of the above rotational movement (FIGS. 5, 8 and 10).

The package formed by the wound film is moved forwards by the products 11 to be packaged which are pushed forwards beneath the winding unit 14 by the positioning unit 13, as already indicated. This pushing movement arranges the packaging on the discharge conveyor belt 15 which thus packaged, discharges it (FIG. 1).

The cycle is repeated each time.

It should be noted that the machine of the present invention provided with a gripping unit 18 of this type operates very rapidly and avoids work stoppages without requiring a positioning of the initial edge of the film to be wound.

The cutting, in fact, is effected once the film has been blocked on the gripping unit 18 and consequently, simultaneously with the generation of a packaged product, the initial edge of the film to be wound is blocked on a subsequent product to be packaged.

It is interesting to note that a new packaging method is also effected in a machine of this type.

A packaging method in extensible film of products 11 fed individually or in groups, is in fact implemented, by means of a positioning unit 13.

A step is first effected for sending a product or plurality of ordered products 11 in line or transversally to a feeding station.

Said product(s) is then sent by means of a positioning group 13 above a shelf 16 positioned beneath a winding unit 14.

This is followed by a step for gripping an initial edge of the winding film by means of a vacuum-effect gripping unit 18 extracted and moved beneath the shelf 16 carrying the product(s) 11.

The subsequent step is to start the winding of the film around the product(s) 11 followed by a releasing step of the film being wound, withheld by the gripping unit after at least one turn of the film around the products 11 and withdrawing the gripping unit from beneath the shelf 16.

After completing the programmed winding turns of film around the products 11, the gripping unit 18 is brought from a rest position withdrawn from the shelf 16, to an extracted position beneath the shelf 16 carrying the product(s) 11.

The suction of the gripping unit 18 is then actuated, for withholding an edge of the wound film and immediately afterwards rotating said gripping unit 18 until a cutting blade 31 integral with the same, cuts a final edge of the film wound around the product(s) 11;

This is followed by a step for moving said wound products 11 to a subsequent discharge belt 15 and at the same time positioning other products to be wound above the shelf 16 beneath the winding group 14, repeating a previous step.

The subsequent steps already proposed are then repeated.

An important feature of the machine and method of the invention lies in being able to effect a continuous winding of a product or plurality of products to form a packaging without any interruption.

This is possible thanks to the provision of the gripping unit which enables both the tail of the film to be cut and the head of the film to be withheld.

This avoids stoppages of the machine and allows packages of wound products to be rapidly formed and discharged in continuous.

Figure 15:
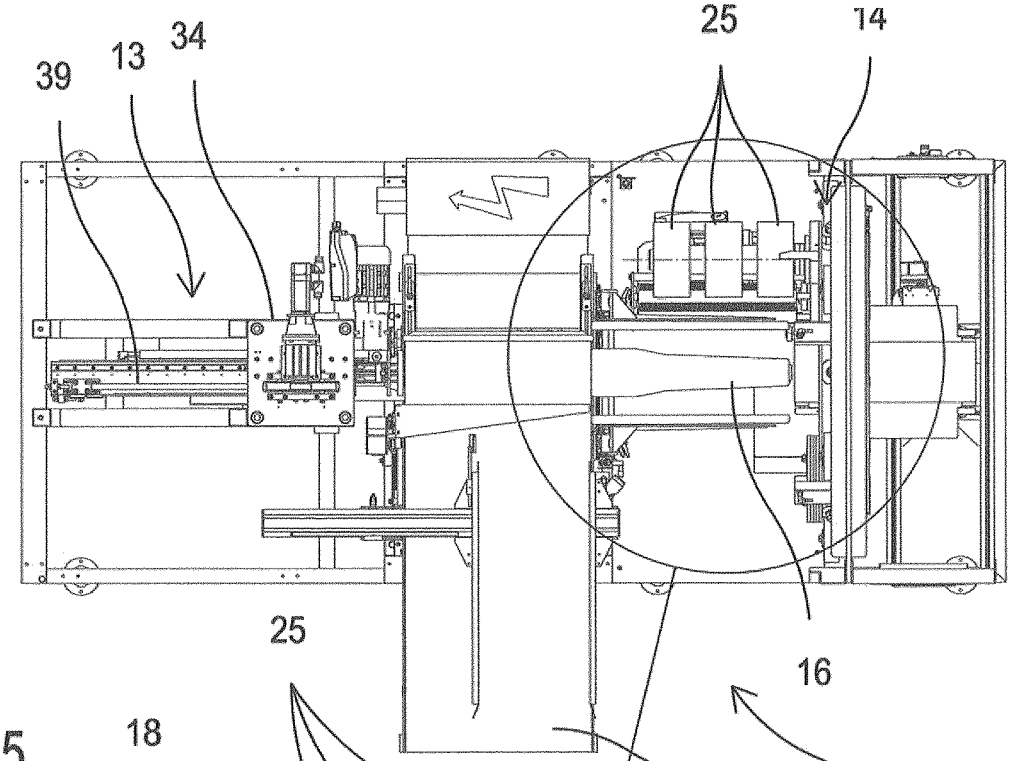
FIGS. 15 and 16 show an overall view of a further embodiment of the winding unit positioned in the machine of the present invention and an enlarged detail.
Figure 16:
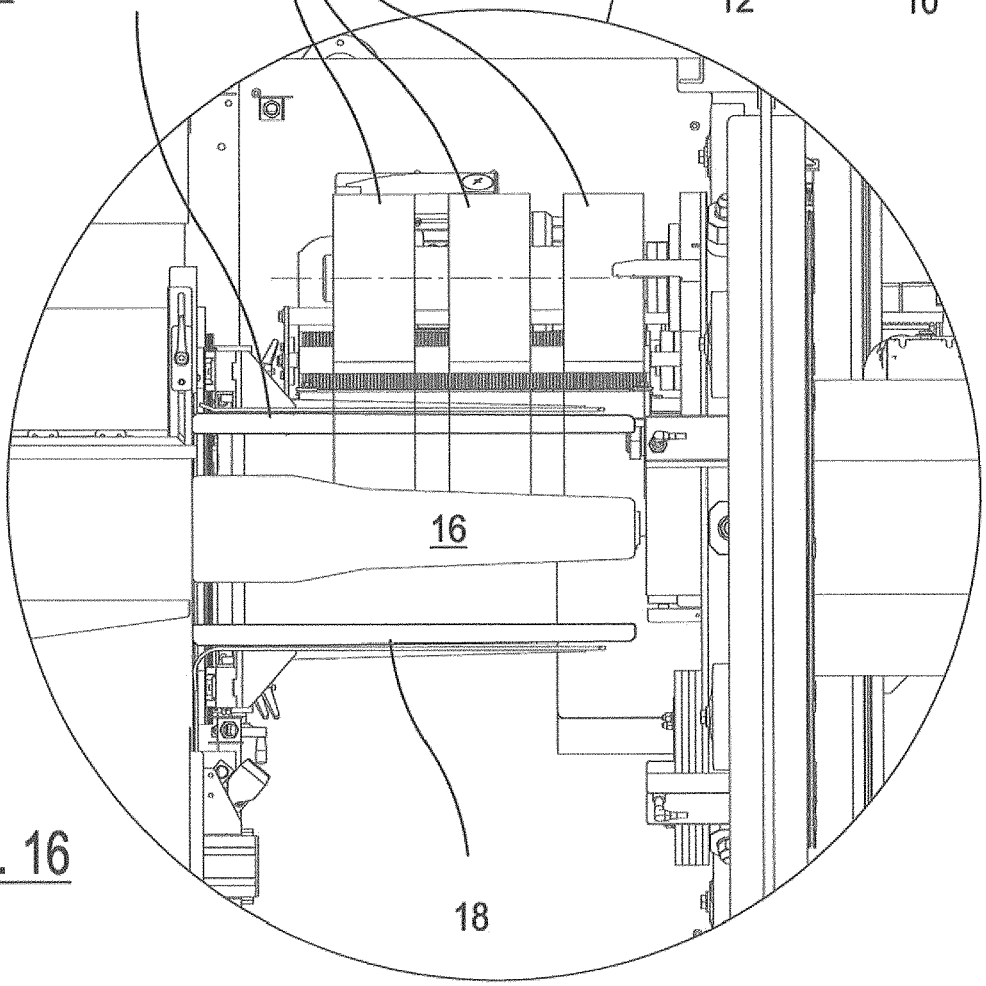
Figure 17:
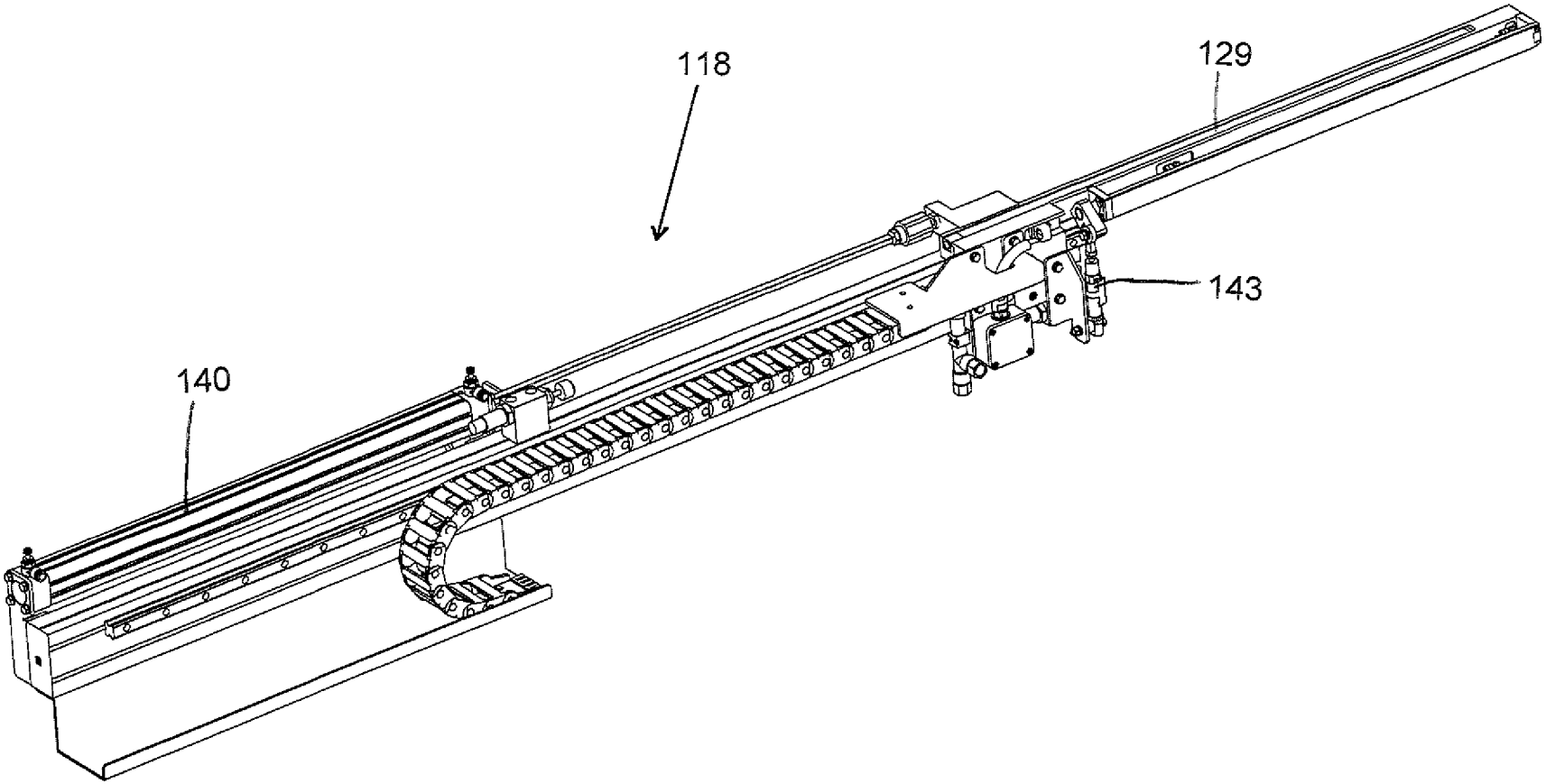
FIG. 17 is a perspective view from above of the gripping unit alone, in a further embodiment in a gripping position.
Figure 19:
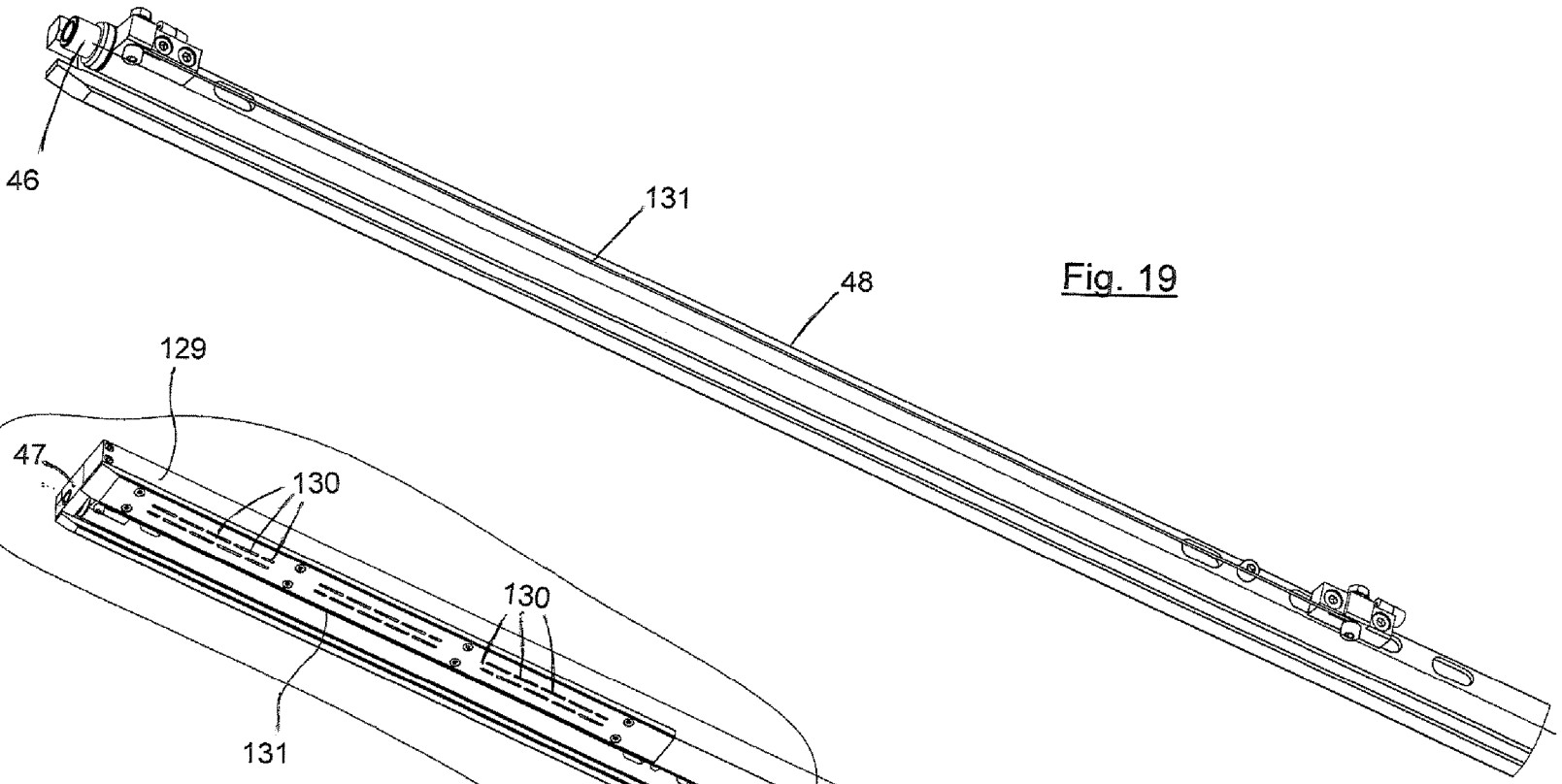
FIG. 19 is an enlarged perspective view of the assembly of a cutting wire in the gripping unit of FIG. 18.
Figure 18:
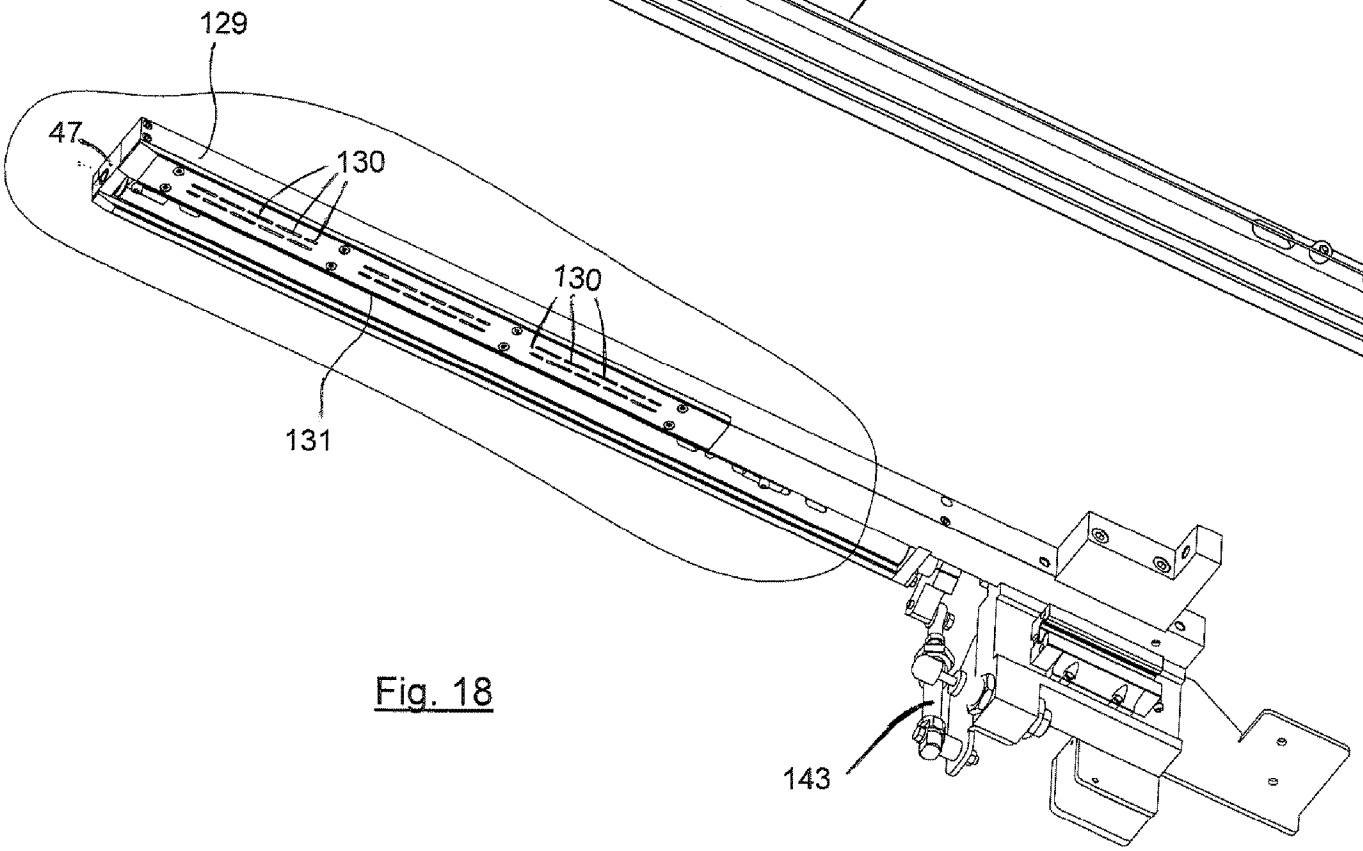
FIG. 18 is a perspective view from below of the gripping unit shown in FIG. 17.

Finally, FIGS. 15 and 16 show overall views of a further embodiment of the winding unit arranged in the machine of the present invention and an enlarged detail. In this example, it can be noted how the machine also allows multiple bundles to be wrapped at a time, forming adjacent packagings. The reel holder 24 in this case carries various reels 25 of film made of extensible plastic material, in the non-limiting example, three.

Once the winding has been effected with the machine and method already previously described, multiple final packagings of bundles are produced. For this purpose, a gripping unit with multiple sectors is used, which allow various edges of the single reels 25 to be withheld. The bundles of pre-spaced products 11 are brought beneath the winding unit 14 with a special accessory assembled on the pusher 34.

Figure 7:
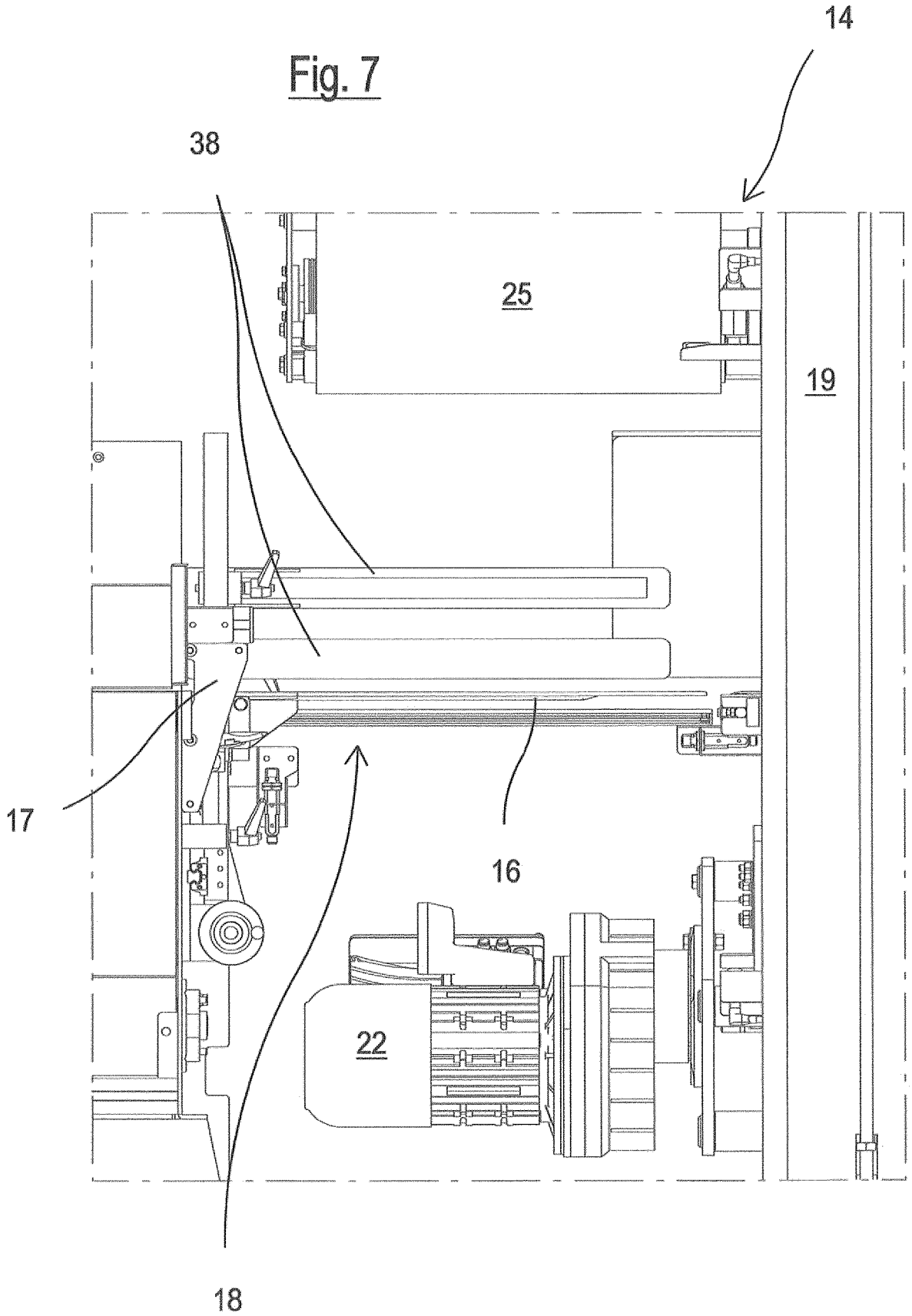

FIGS. 17 to 21 show a second possible embodiment of the gripping unit alone in an extracted gripping position when positioned beneath the shelf as shown in FIG. 7 or 12 of the previous embodiment.

It should be noted that the same reference numbers are used for the same elements, whereas numbers preceded by the index "1" are used for similar elements or having the same function.

The figures therefore show a vacuum-effect gripping unit 118 also provided with a cutting element suitable for acting on the film. The gripping unit 118 comprises a hollow section 129 which carries suction holes or sectors 130 on its lower surface and facing the film.

A cutting wire 131 is positioned alongside this hollow section 129. The cutting wire is blocked at opposite ends supported on a bar 48 which provides end pins 46. Said pins 46, and therefore said bar 48, are positioned in supporting extensions 47 of the structure of the gripping unit 118.

At least one actuator 143, constrained to the structure of the gripping unit 118, causes the rotation of at least one arm 45 for bringing the cutting wire 131 in engagement with the film. Also in this case, a further actuator 140 is provided, which moves the gripping unit 118 between the rest position concealed inside the structure withdrawn from the shelf 16 and the gripping position of the extracted film beneath the shelf 16.

Figure 20:
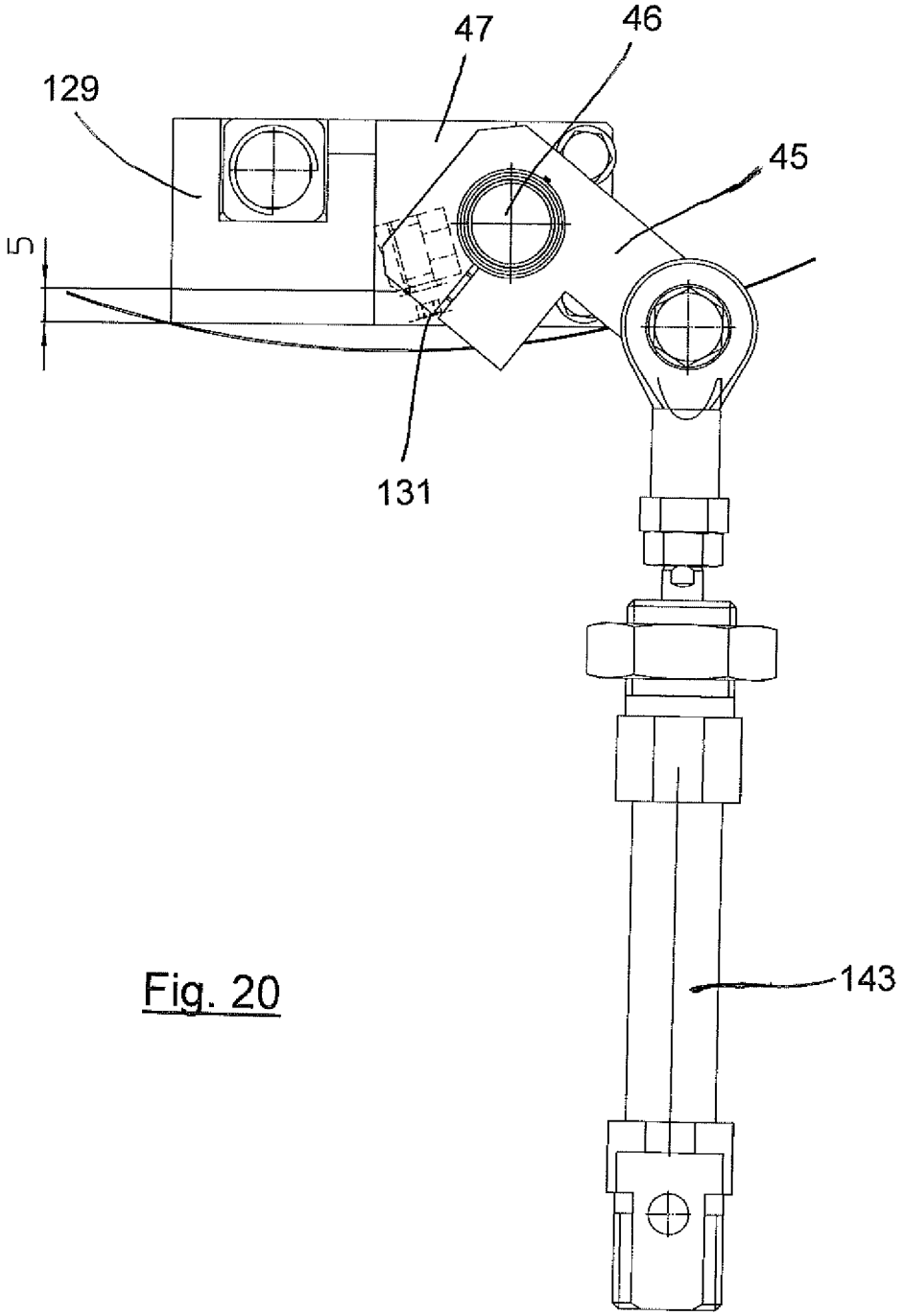
FIGS. 20 and 21 are two enlarged raised front views of an end of the gripper in a gripping position and in a cutting position.
Figure 21:
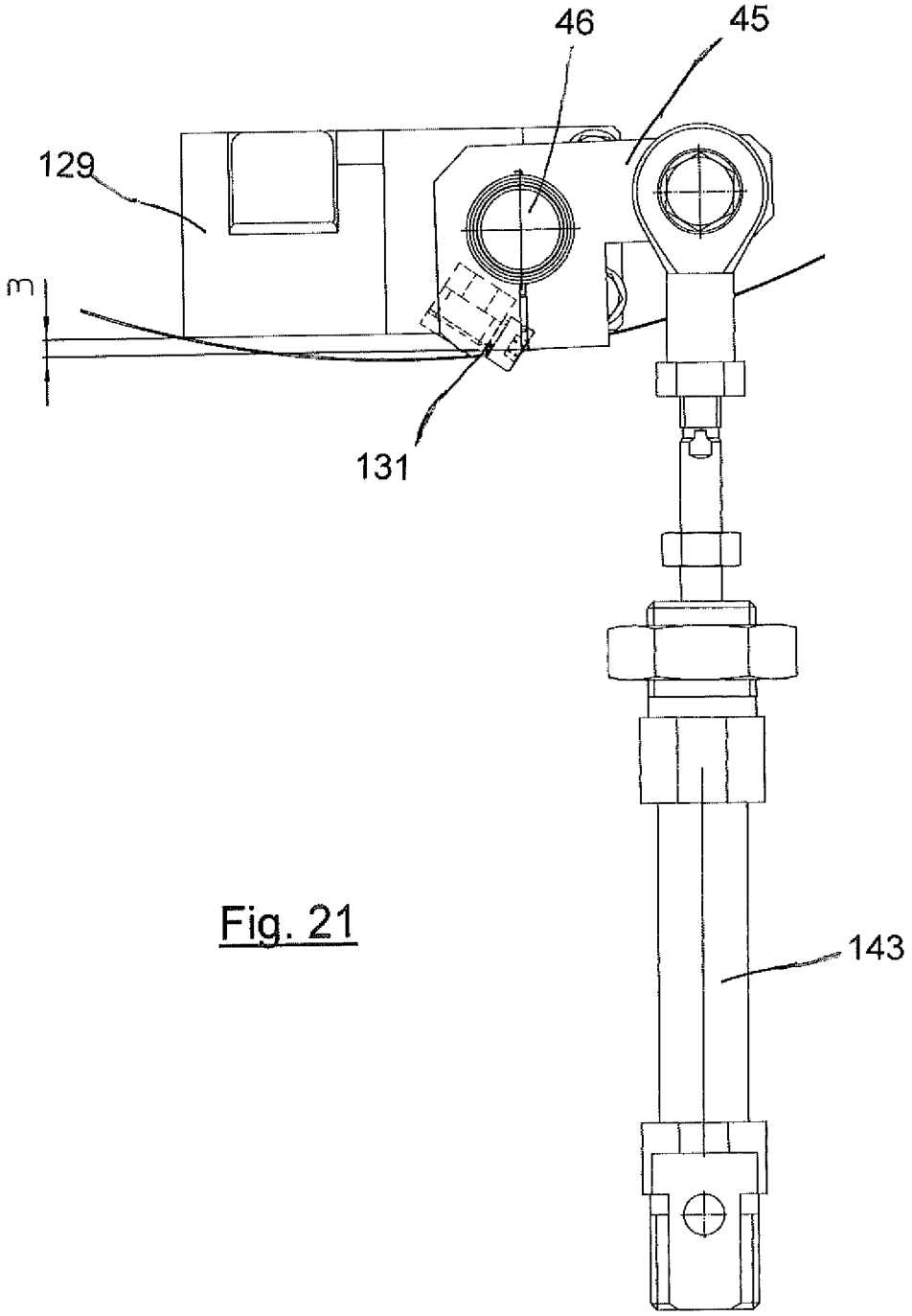

FIGS. 20 and 21 are two enlarged raised front end views of the gripping unit in a gripping position of the film and in a cutting position of the film.

It can be noted in fact that the actuator 143 causes the rotation of the arm 45 and consequent movement of the cutting wire 131. The cutting wire 131 is thus brought from a disengaged and distanced position of the film (FIG. 20) to an engaged and cutting position of the film (FIG. 21).

The forms of the structure for providing a machine and a method of the present invention, as also the materials and assembly modes, can naturally differ from those shown for purely illustrative and non-limiting purposes in the drawings.

The protection scope of the present invention is defined by the enclosed claims.

The invention claimed is:

1. A packaging machine using extensible film for a product fed in groups or individually, comprising:

a conveyor for feeding the product;

a positioning unit of the product;

a film winding unit of the product either individually or in groups; and a discharge conveyor, positioned at an outlet of the film winding unit, wherein said film winding unit is a ring winder comprising a ring or a slewing ring rotating with respect to guiding rolls positioned on a supporting frame, wherein said ring winder is arranged on a plane perpendicular to an advance direction of the product (11), wherein a shelf is provided beneath said film winding unit, cantilevered to extend according to said advance direction of the product and connecting said conveyor with said film winding unit, wherein, beneath said shelf, a vacuum-effect gripping unit is positioned for gripping the extensible film, carrying a cutting element for cutting the extensible film coupled therewith, wherein said vacuum-effect gripping unit and said cutting element are configured to be moved along a longitudinal axis alternatingly and selectively from a withdrawn rest position from said shelf to an extended position for gripping and cutting the extensible film beneath said shelf, wherein the cutting element is associated with said vacuum-effect gripping unit, and wherein the cutting element is rotatable about the longitudinal axis in relation to said vacuum-effect gripping unit.

2. The packaging machine according to claim 1, wherein said vacuum-effect gripping unit comprises a hollow tube provided on a lower portion with suction holes or sectors for withholding the extensible film in a gripping position.

3. The packaging machine according to claim 1, wherein the cutting element is a cutting blade.

4. The packaging machine according to claim 1, wherein said vacuum-effect gripping unit is configured to be rotated about the longitudinal axis between a film gripping position and a film cutting position.

5. The packaging machine according to claim 1, wherein said vacuum-effect gripping unit is caused to move longitudinally between said withdrawn rest position and said extended position by an actuator and is further caused to rotate by a second actuator, which is also connected to a vacuum pump.

6. The packaging machine according to claim 1, wherein the cutting element is a cutting wire is associated with said vacuum-effect gripping unit, for cutting the extensible film.

7. The packaging machine according to claim 6, wherein said cutting wire is blocked at opposite ends supported on a bar, which provides end pins positioned in supporting extensions of a structure of the vacuum-effect gripping unit, said cutting wire and said bar being rotatable about the longitudinal axis with respect to said vacuum-effect gripping unit.

8. The packaging machine according to claim 7, wherein at least one actuator, constrained to the structure of the vacuum-effect gripping unit, causes a rotation of at least one arm to bring the cutting wire in engagement on the extensible film.

9. The packaging machine according to claim 1, wherein a reel holder for at least one reel of the extensible film is integrally assembled on said ring winder, a support of a rubberized tensioning roller and a pair of return rollers for the extensible film being associated with said reel holder.

10. The packaging machine according to claim 9, wherein said reel holder supports a plurality of reels spaced apart from each other.

11. The packaging machine according to claim 10, wherein said gripping unit has multiple sectors so as to withhold various edges of the plurality of reels positioned on said reel holder.

12. The packaging machine according to claim 1, wherein said feeding conveyor of the product is a conveyor belt positioned in line or at 90° C. with respect to said positioning unit.

13. A packaging method using extensible film for products fed in groups or individually, comprising the following steps:

sending a product or plurality of ordered products in line or transversally to a feeding station;

pushing said product or ordered products with a positioning unit above a shelf positioned below a winding unit;

gripping an initial edge of the extensible film with a vacuum-effect gripping unit configured to be moved beneath the shelf carrying the product or ordered products;

starting a winding of the extensible film around the product or ordered products, releasing the extensible film being wound, held by said vacuum-effect gripping unit after at least a first turn of the extensible film around the product or ordered products and withdrawing the vacuum-effect gripping unit beneath the shelf;

after completing programmed winding turns of film around the product or ordered products, bringing the vacuum-effect gripping unit again from a rest position withdrawn from the shelf to an extracted position beneath the shelf carrying the product or ordered products;

actuating a suction of the gripping unit for withholding an edge of the extensible film after winding and immediately afterwards rotating at least one cutting wire associated with the vacuum-effect gripping unit about a longitudinal axis, to cut a final edge of the extensible film wound around the product or ordered products;

moving said product or ordered products after winding to a subsequent discharge belt and at a same time positioning other products to be wound above the shelf beneath the winding unit; and repeating the steps of the method.

* * * * *